US007086570B2

(12) United States Patent
Canegallo

(10) Patent No.: US 7,086,570 B2
(45) Date of Patent: Aug. 8, 2006

(54) SYSTEM FOR THE EXTRACTION OF LIQUID AND CREAMS WITH A REGULAR AND CONTINUOUS FLOW

(75) Inventor: Pierottavio Canegallo, Tortona (IT)

(73) Assignee: IDEALPACK S.r.l. (IT)

( * ) Notice: Subject to any disclaimer, the term of this patent is extended or adjusted under 35 U.S.C. 154(b) by 0 days.

(21) Appl. No.: 10/511,082

(22) PCT Filed: Apr. 15, 2003

(86) PCT No.: PCT/IT03/00235

§ 371 (c)(1),
(2), (4) Date: Oct. 14, 2004

(87) PCT Pub. No.: WO03/089332

PCT Pub. Date: Oct. 30, 2003

(65) Prior Publication Data

US 2005/0178798 A1 Aug. 18, 2005

(30) Foreign Application Priority Data

Apr. 19, 2002 (IT) ..... MI2002A0839

(51) Int. Cl.
*B67D 5/42* (2006.01)

(52) U.S. Cl. ..... 222/386.5; 222/559

(58) Field of Classification Search ..... 222/95, 222/105, 206, 93, 386.5, 107, 215, 559
See application file for complete search history.

(56) References Cited

U.S. PATENT DOCUMENTS

| | | | | |
|---|---|---|---|---|
| 3,791,557 | A | 2/1974 | Venus, Jr. | |
| 3,961,725 | A | 6/1976 | Clark | |
| 4,251,032 | A * | 2/1981 | Werding | 239/323 |
| 5,111,971 | A * | 5/1992 | Winer | 222/95 |
| 5,120,315 | A * | 6/1992 | Hessel | 604/132 |
| 5,160,072 | A | 11/1992 | Nye | |
| 5,232,126 | A * | 8/1993 | Winer | 222/95 |
| 6,345,739 | B1 * | 2/2002 | Mekata | 222/389 |

FOREIGN PATENT DOCUMENTS

| | | |
|---|---|---|
| EP | 0 622 311 A2 | 11/1994 |
| FR | 2 371 238 | 6/1978 |

* cited by examiner

*Primary Examiner*—Philippe Derakshani
(74) *Attorney, Agent, or Firm*—Dickstein Shapiro Morin & Oshinsky LLP

(57) ABSTRACT

The system for extracting, dosing, dispensing, with controllable regular and continuous flows, liquids and creams from their container, in the absence of gas, comprises a thick hollow rod provided with low-softening means to seal a thermoplastic sac on which is shod an elastomeric balloon.

9 Claims, 7 Drawing Sheets

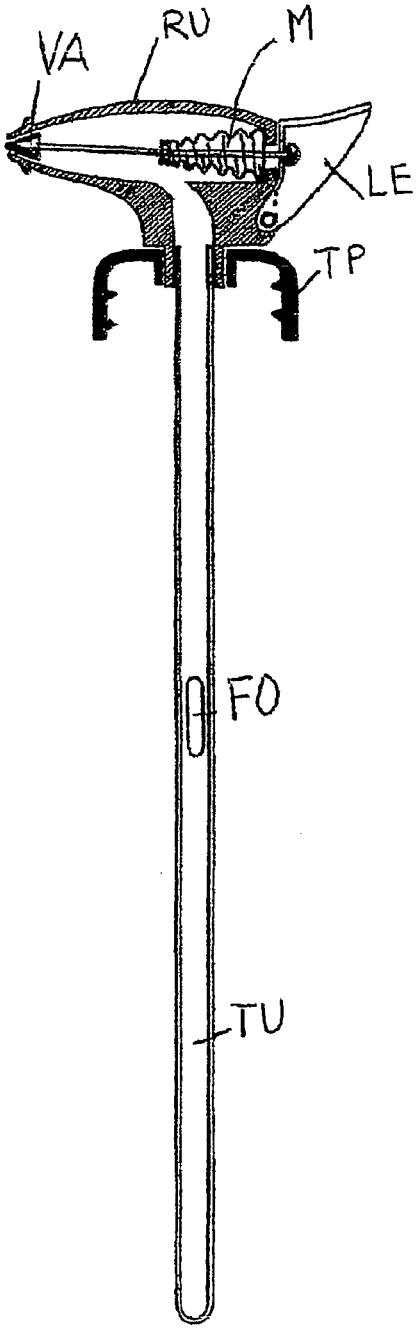
FIG. 1
FIG. 2
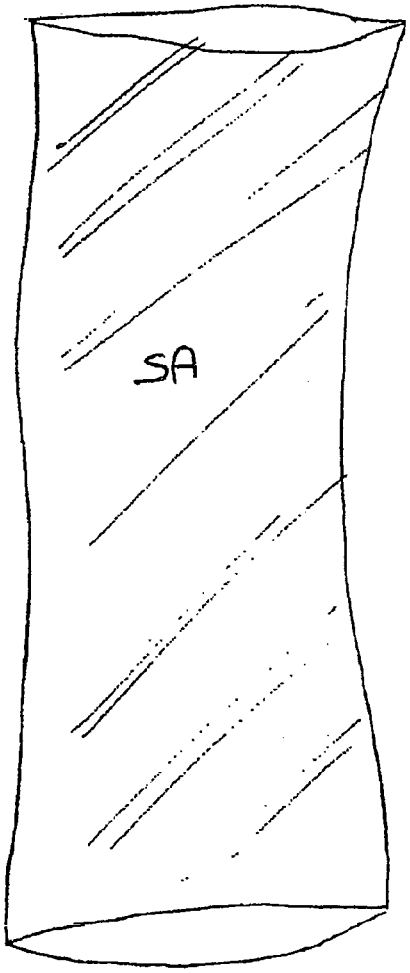
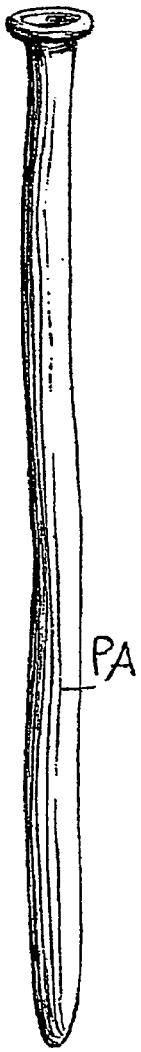
FIG. 3

FIG. 4
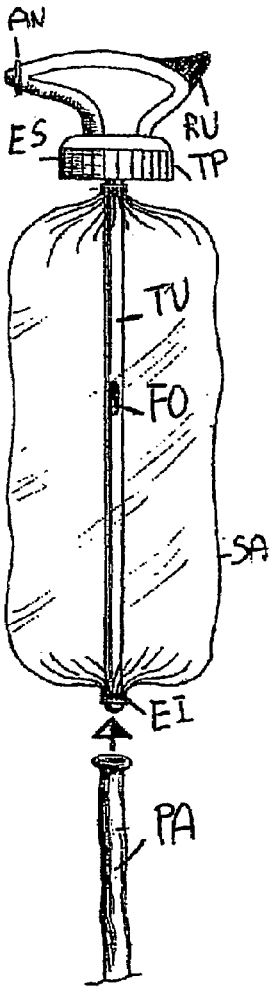
FIG. 5
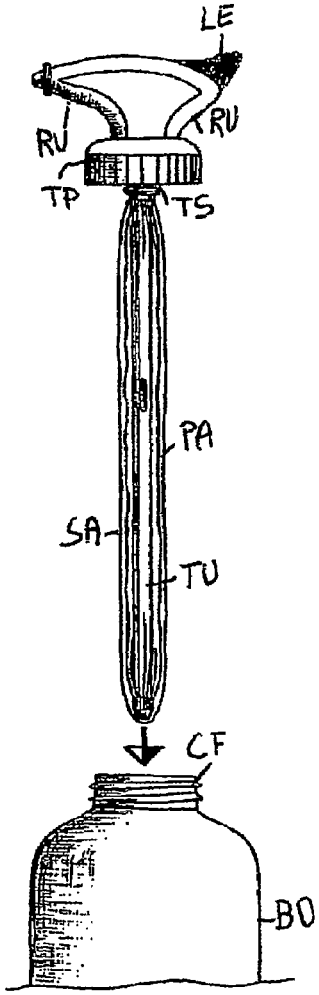
FIG. 6
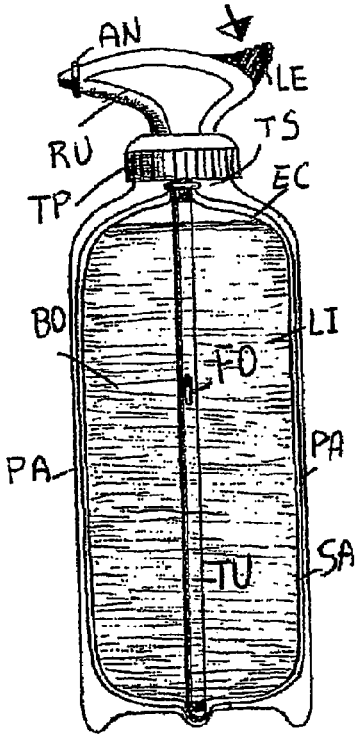
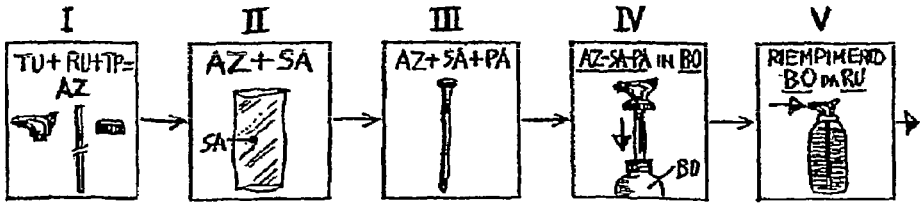
FIG. 7

SYSTEM FOR THE EXTRACTION OF LIQUID AND CREAMS WITH A REGULAR AND CONTINUOUS FLOW

BACKGROUND OF THE INVENTION

The present invention concerns a system for extracting, dosing, dispensing etc., with controllable regular and continuous flows, essentially liquid substances from their containers, by means of a multi-component device, in the absence of pressing and nebulizing gas and the like, said system generally comprising:- a thick hollow rod;- a sac or bag of thermoplastic material, containing said liquids, creams and the like to be dispensed;- a balloon or vesica of substantially elastomeric material, and;- a container such as a bottle or bag-box.

PRIOR ART

So many extractors, dispenser, dosers and the like are known, generally comprising a small tube with tap, inserted in the liquids container: acting on a lever or pressure botton of the tap, air is made to enter in the tube provided with at least a hole and the liquid are pushed out under the air pressure acting directly on the container liquid; to improve the working a gas can be associated to the liquid to be extracted however the flow remains irregular, discontinuous and sometimes violent producing sprinklings and unusefull liquid waste.

Being this field a very crowded patent field, the apparently most relevant prior Art seems to be European patent no. 0 58 700, which on its turn cites U.S. Pat. Nos. 3,672,543, 3,738,536, 3,791,557, and 3,907,166 which is extensively acknowledged in the preamble of claim 1 directed to an apparatus (12) for containing and dispensing a fluid medium under pressure, comprising a flexible container (36), capable to be folded and expanded when filled with said medium,- a resilient tubular member (33) which is positioned outwardly of said container (36) and expands upon its filling with the fluid under pressure;- valve means (3) to prevent evacuation or expulsion of selective amounts of the pressurized fluid under the inward forces provided by said resilient means. of selective amounts of the pressurized fluid under the inward forces provided by said resilient means.

The chacterizing clause of claim 1 of said EP 0058700 recites that a sleeve (34) around flexible container (36) is in made of resilient fabric material and said resilient tube (33) surrounds sleeve (34). Certainly this patented system has interesting features however its technological complications seem to have prevented its commercial success.

SUMMARY OF THE INVENTION

Object of the present invention is now to provide a system for the extraction, dosing, dispending etc., even high-density liquids and creams, which system does not show the drawbacks of the prior Art, in particular the complications above mentioned.

The system of the invention essentially comprises:- a support in the form of a thick hollow rod provided with inlet-outlet holes and head and bottoms welding and/or fitting means;- a sac or bag of thermoplastic material to contain liquids or creams to be dispensed, said sac being provided with means to be reciprocally associated to said welding and/or fitting means of the rod;- a balloon or vesica of elastomeric material associated and acting on said bag, and;- a container in form of bottle or bag-box to accomodate said rod, sac, balloon, tap and cap assembled to each other, only the sac being in contact with the liquids or creams.

The main characteristics of the invention are recited in the appended claims which are considered here incorporated.

BRIEF DESCRIPTION OF THE DRAWINGS

The various features and advantages of the invention will more clearly appear from the description of the embodiments shown (as not limitative examples) in the accompanying drawings in which:

FIGS. 1, 1A, 1B, 2, 3, 3A, 4, 5, 5D, 5E, 5F and 6 are schematic front views of the system;

Figure 1A:
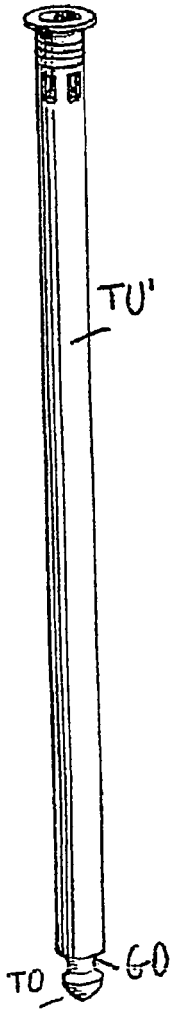
Figure 1B:
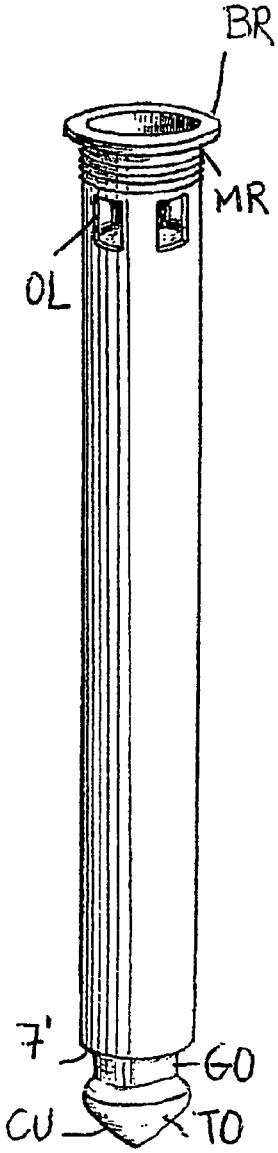

In the figures TU indicates a critical rod with central hole FO (in FIGS. 1, 4, 5 and 6) and/or with liquid inlet-outlet holes OL (in the remaing figures) having substantially the height or length of the bottle BO and a diameter DT substantially lower than the bottle diameter DB. To the top head of TU are associated a conventional tap RU having lever LE and spring M acting on an opening and closing valve VA, a ring AN to engage the filling tank (not shown), and a cap TP to corkscrew on the bottle BO.

To the ensemble comprising rod TU, tap RU and cap TP of FIGS. 1–3 is associated a sac or bag SA (FIG. 2) of a thermoplastic material showing good properties of both thermosealability and gas barrier, which is sealed to the superior and inferior ends of said rod TU within the bottle BO (FIG. 4). This sac or bag SA consists of a mono- or pluri-layer material in particular of a laminate preferably coextruded and comprising one or more films or sheets of polymers and/or copolymers of ethylene, propylene, butene (and/or other polyolefins), amides, phthalic esters, styrene and the like.

According to a feature of the inventions TU is a rigid hollow body made of thermoplastic materials preferably of co-polymers of ethylene, propylene etc. possibly reinforced with fillers, having a thickness substantially according to the height or length of the bottle BO, the volume and the density of the contained substance, etc., f.i. of from 1 to 300 mm; on said rod is welded a sac SA on which is fitted (shod) the balloon or vesica PA made of substantially elastomeric material, preferably of mixtures of natural and/or synthetic rubbers. Said balloon PA, which is the pushing element of the liquid or cream contained in SA, has thickness, f.i. of from 10 to 300 microns according to the pressure PA has to excert on SA, and thus again substantially according to volume, density and fluency of the liquids or creams to be extracted.

In the FIGS. 1, 2 and 3 the components TU, SA and PA of the system are shown separated i.e. disassembled, and in their simplest form, whereas in FIG. 4 is shown the rod TU having the thermoplastic sac SA sealed at its upper end ES and lower end ET, said rod having been previously provided with tap RU and cap TP.

The component (balloon) PA is shown detached and below the lower end EI of bag SA sealed to said rod TU. In the successive FIG. 5 can be seen in side view said elastomeric balloon PA shod on the bag SA, on its turn sealed to said terminal ends ES and EI of rod TU.

In the lower part of FIG. 5 is partially shown a bottle BO on the head threaded portion of which will be screwed to cap TP as shown in FIG. 6; the sac SA now within PA and bottle BO will be successively filled up with the liquid or cream to be dispensed with uniform controllable continuous flow, without sparklings and waste of said liquids or creams LI. This is now brought about by simply actioning the lever LE of tap RU. The balloon PA acting on the sac SA containing the liquid LI (with no contact either with rod TU or with the bottle BO but in contact only with the inner face of SA) allows the full evacuation of the sac embodying thus a complete utilization of its content.

In FIG. 5 the complete system, i.e. the rod TU with tap RU and cap TP, with said thermoplastic bag SA sealed at its ends to TU and with the elastomeric baloon PA fitted on same bag SA, is shown in the rest conditions i.e. without any inflation. On the contrary in FIG. 6 the inflated system is shown with the balloon PA acting on the bag SA and thereby on the liquid content LI.

Figure 3A:
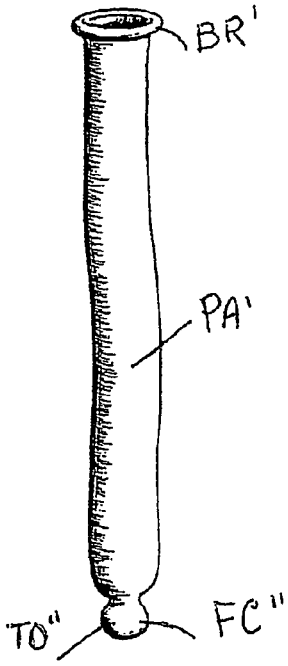
Figure 3D:
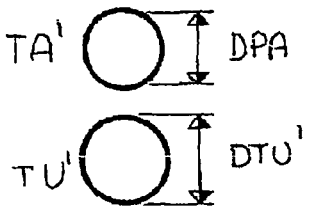

Advantageously said balloon PA has preferably a diameter slightly lower than that of the rod (as shown in FIG. 3D), is closed at its lower end EP, is open at its upper end EC where it is sealingly pressed on the head of the rod TU because of its elastic characteristics.

Figure 7:
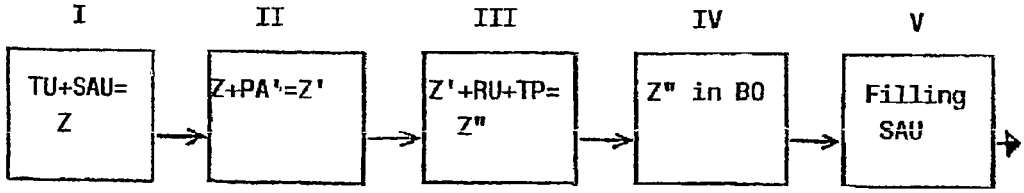
FIGS. 7 and 7' are block schematic diagrams of methods to bring about the system.

In FIG. 7 a particularly simple and effective method to embody the above system is shown in which:- in step I) tap RU and cap TP are associated to rod TU, this association TU+RU+TP forming a partial assembly being indicated with reference AZ;- in step II) bag SA is sealed to the ends ES and EI of rod TU (in the case in which said bag is open to its ends: at the limit, said sac SA could be closed at the lower end and thus require no lower sealing);- in step III) balloon PA is shod on sac SA by bringing its lower closed end to overlap the lower sealed end of bag SA and its upper end to fixedly press under the expansion of collar TS;- in step IV) the assembly TU+RU+TP+SA+PA is inserted in the bottle BO and cap TP is screwed thereupon; and- in step V) liquids, creams and the like are filled in the sac of the assembly. This system worlds very well with liquid and creams generally having usual density, however when the density and flowability are rather high or undergo time-temperature variations it is preferred to apply the embodiment shown in the FIGS. 1A to 1E, 2A, 3A, 3D, 4A, 4B, 5A, 5B, 5D, 5E, 5F, 6A, 6B and 7'I-V. This improved embodiment is particularly advantageous also from an industrial point of view, as the system components can be sealed and assembled easely quick and "on line".

The hollow rod TU' of FIGS. 1A to 1E shows:- a) a male termination at its lower end preferably obtained through a top-like body TO consisting of a pressure fitting having a conical portion CU, a throat GO and an annular flange AF with a small pike 7, in correspondence to the lowest end portion of hollow rod TU;- b) inlet-outlet holes OL on its upper portion;- c) an edge or rim BO and between said BO and holes OL a thread-like series of mini-protrusions MR formed characteristically of plastic material having a softening point lower than the melt point of the rod forming material; and a watertight bulkhead BH.

Among the so many advantages of this complex rod, following are to be particularly stressed:- 1) a strong (the longer the thicker) hollow rod TU' keeps alway straight and bolt up right the whole inner system TU'+RU+TP+SAU+PA, avoiding possible inflections or inclinations;- 2) makes easier the application of the sac;- 3) allows correct fillings without sparklings and deformations;- 4) allows an easy insertion of the balloon on the sac;- 5) avoids flagwavings when the sac is filled up. In particular the low-softening protusions MR allow a safe welding of sac SAU to the head of the rod TU' the in-out-lets OL on the upper portion of TU' avoid the sparkling formation and the bulk head BH avoids liquid penetrations in the hollow rod major portion (blind portion below BH) from which the liquid could be difficultly removed.

the the male conical closure TO of TU', allows a good engagement or sit of the base of TU' within a corresponding female cavity FC in the bottom of the bottle BO or bag box BB, while its throat GO allows a strong coupling of the preformed female cavities TO', TO" of the bottoms of sac SAU and balloon PA' with the terminal TO of TU', said TO and cavities TO' and TO" having the complementary shapes requested for the realization of optimal male-female couplings.

According to a further feature of the invention, a cylindrical heater H, consisting of a cylinder body CC on the outer surface of which are provided thin protrusions or rings RIS made of high-friction material, is introduced in the blind major portion BL of TU' delimited by the upper bulkhead BH and the lower conical top-like male closure TO: it has been surprisingly found that by shaking TU' and causing an up-down movement of H, heat is generated on the inner surface of said blind region BL of TU', which is transmitted to the outer surface of said BL and thereby to the liquid or cream in the sac SAU. In other words, the heater H is made like the head of a motor piston provided with scraper (oil control) rings whereby by shaking TU' and causing up-down strokes of H, the friction material of said rings RIS generates sufficient heat to enhance the flowability of high density liquids or creams. By means of this simple device, the system according to the invention can work effectively to dose chocolates, james, honey, fruit squashes, mixtures etc. etc.

Moreover the length, diameter, thickness (Th) of the rod TU' are established according to the volume, density, flowability etc. of the liquids and creams to be dispensed.

Figure 1C:
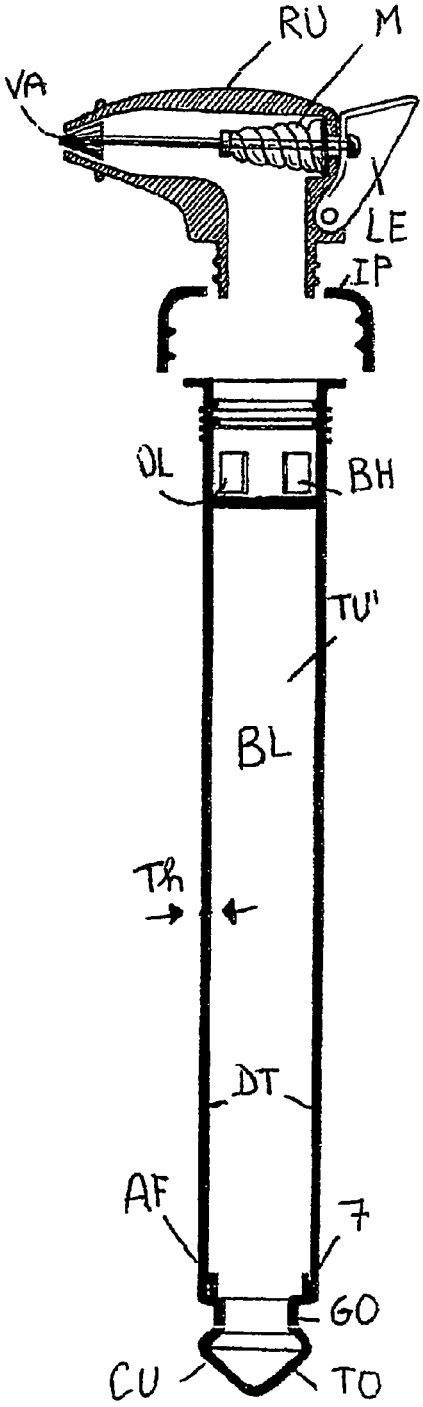
FIGS. 1C, 1E, 2A, 3D, 4A, 4B are schematic cross-sections.
Figure 1D:
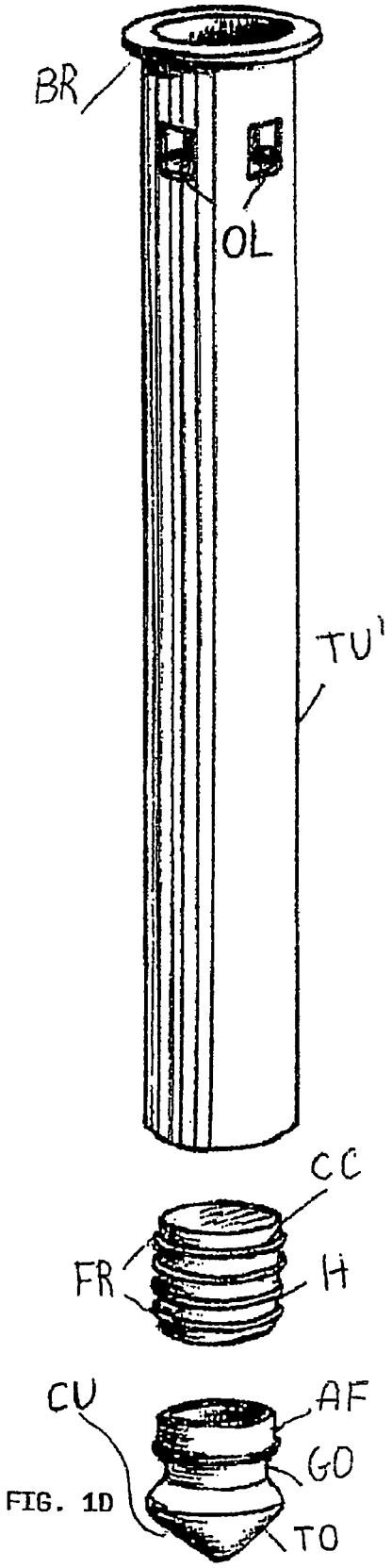
FIGS. 1D, 5A, 5B are partially exploded front views.
Figure 1E:
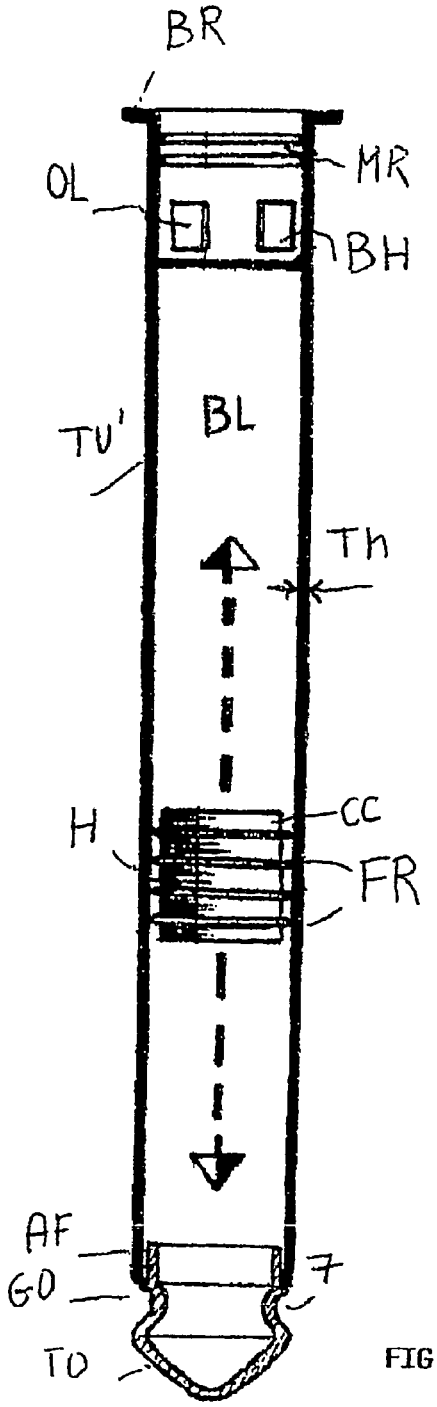
Figure 2A:
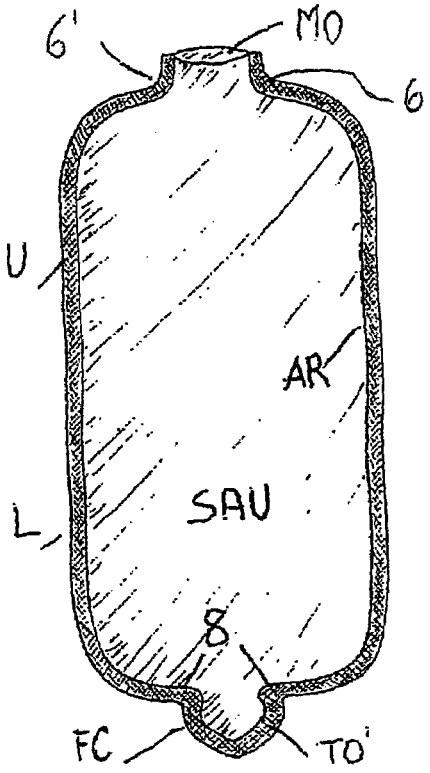
Figure 4A:
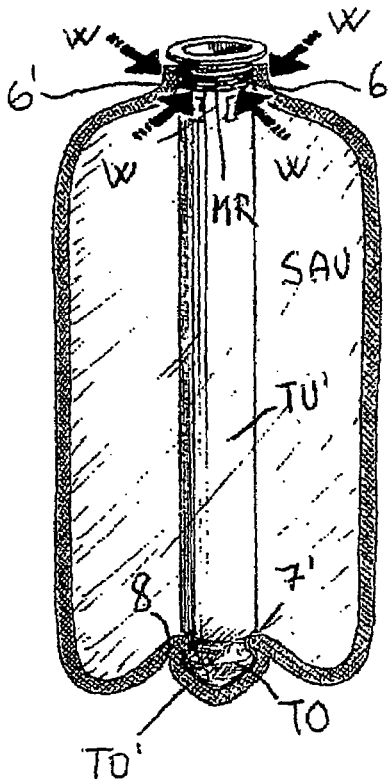
Figure 4B:
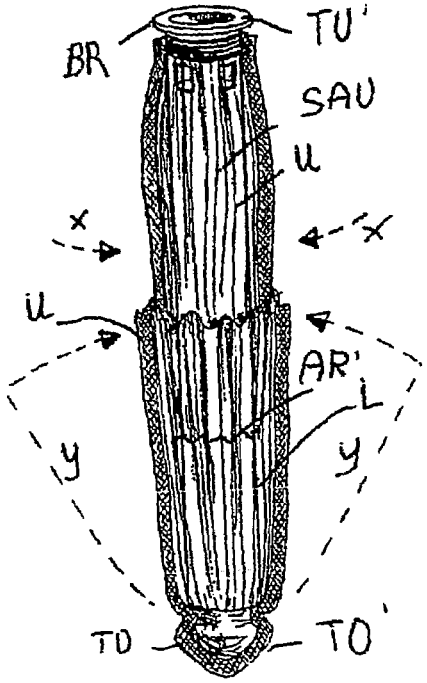

As shown in the FIGS. 2A, 4A and 4B the sac SAU is a preformed body of thermoplastic resins, having a bottom female cavity FC with the inverse shape of the male top TO of the rod TU' and at its upper end a restricted mouth MO which free end 6' acts as the female 6 of the threaded head MR of rod TU'. Typically the sac SAU is formed as an umbrella (FIG. 4B) and is provided with a curling or crumpling ARR which is in the upper portion shown in FIG. 4B when the sac is empty compacted and shorter than TU', to facilitate its insertion in the balloon PA; and goes in the lower position AR' when same sac is filled up, needs to enlarge, and becomes shorter than TU'. This compensation is ignored in the U.S. Pat. No. 4,423,829 in which FIG. 2 shows the sac detached from the bottom 32 of the bottle whereas FIG. 1 shows it very closed to said bottom.

In FIG. 4A the arrows W indicate the welding of said mouth MO of SAU to the low softening head MR of TU'. FIGS. 2A, 4A and 4B show the case of sac SAU for heavy volumes and high-density liquids which require thick weldings TW.

FIG. 3A shows a balloon PA' also provided with a female bottom closure FC' complementary to the male termination TO of the rod TU' but shghtly smaller in size than TO. Similarly FIG. 3D shows a diameter DPA of balloon PA' slightly smaller than the diameter DTU of hollow rod TU'. This is important especially to obtain a complete evacuation of the sac.

FIG. 3B shows the insertion in the balloon PA' of the compacted sac SAU (previously welded to the head and bottom of TU').

In opposition to the procedure of FIG. 7 the application of the tap RU and cap TP, is now carried out (as in FIG. 513)

after the application of sac SAU on the balloon PA'; this as is advantageous for an industrially effective assembly operation.

Figure 5A:
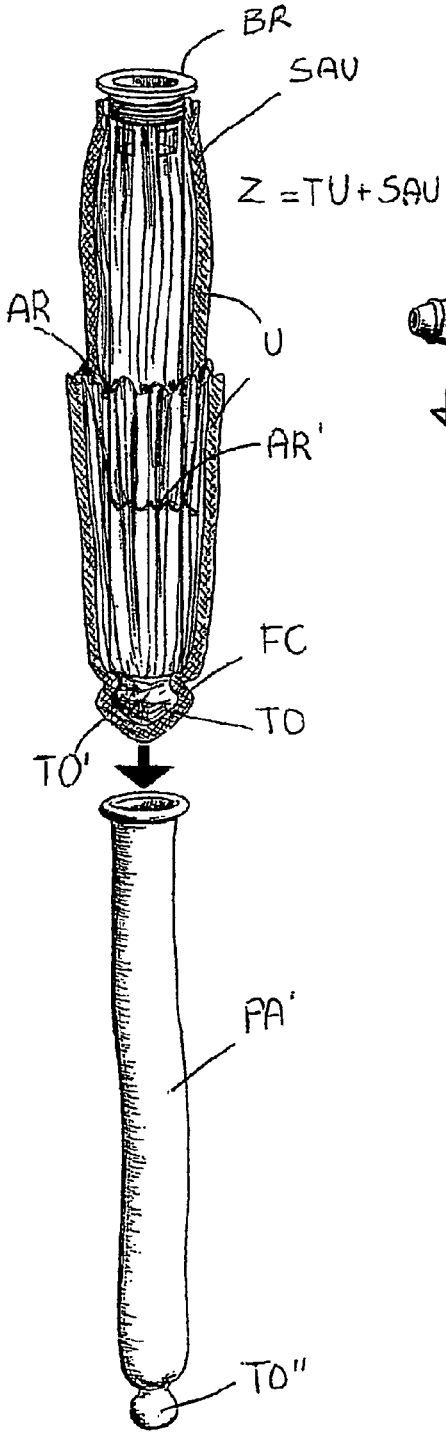
Figure 5B:
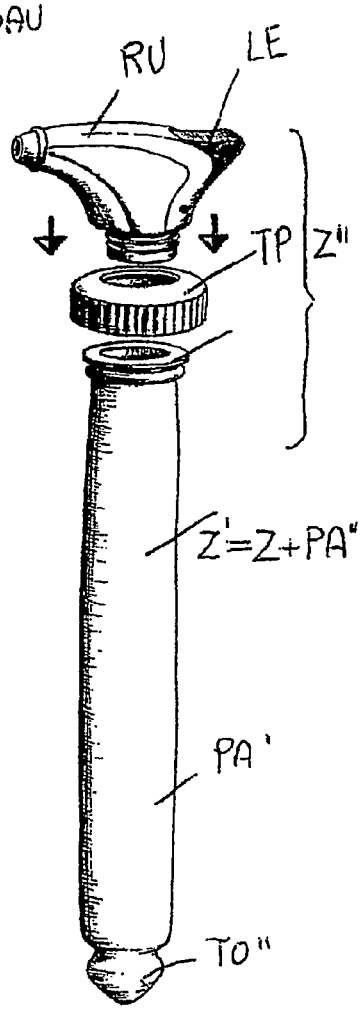
Figure 5D:
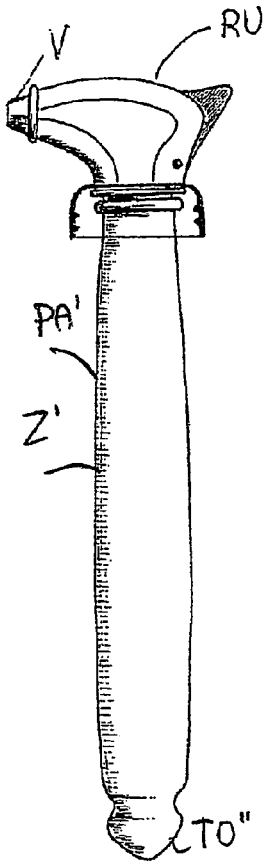
Figure 5E:
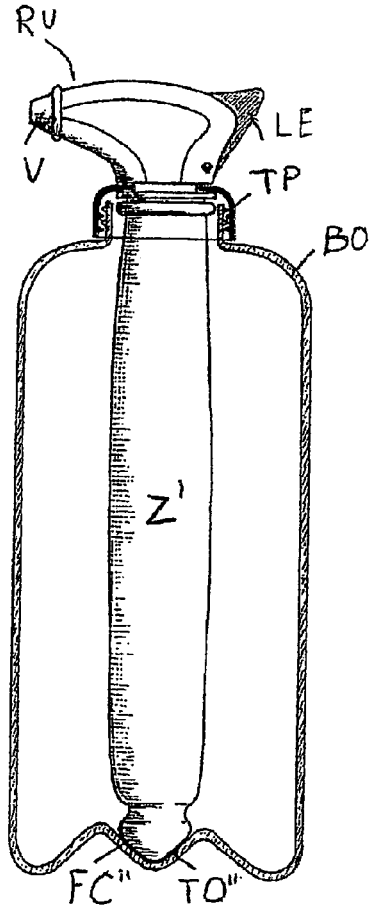
Figure 5F:
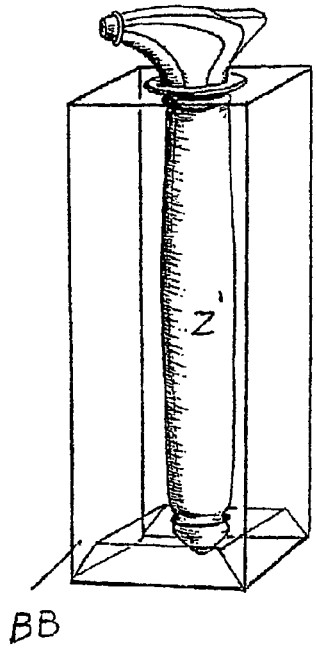

FIG. 5D shows the complex Z'=TU'+SAU+PA'. FC" indicates the female cavity in the bottom of bottle BO or bag box BB of FIG. 5B and FIG. 5E its insertion in a bottle BO forming thus the complex Z"; FIG. 5F shows Z' in said bag box BB. FIG. 6 shows the filling operation, i.e., liquid IN (coming from a non represented tank) enters the sac SAU (as shown in FIG. 4B) through valve VA (as shown in FIG. 1C), tap RU+TP, and the holes OL (acting now as inlets) and fills the same sac. FIG. 6 also shows the evaluation by acting (arrow) on the lever LE, and forcing liquid LI to go out of SAU through holes OL now acting as outlets.

FIG. 7' shows an industrially advantageous method in which in contrast with FIG. 7, in the step I) the hollow rod TU' provided with the bottom top-shaped male terminal TO and with the head collar protrusions MR of low-softening resin, is inserted in sac SAU (open) which is welded to said low softening rings MR of the head of TU' and forced to accomodate male TO in the sac bottom female FC; in step II), balloon PA' is shod on umbrella shaped sac SAU; in step III) the tap RU and cap TP are applied on the edge BO of TU'; in step IV) the complex Z" so obtained is inserted in the bottle BO; and in step V) sac SAU is filled with liquid.

As anticipated the system of the invention is very effective reliable and flexible in the sense that it can now be applied to any liquids, creams and the like to any volume thereof, and, moreover, thanks also to the strokes of the heating cylinder H (caused by simply shaking the hollow rod) to any liquid or cream susceptible of undergoing consistency variations with the time and/or outer temperature especially in the winter or in the periods and locations with strong temperature excursions.

Naturally the advantages of the system of the invention are higher and more consistent the more precious are the creams and liquids in the sac.

Even if the invention has been described with reference to the embodiments shown if the drawings (for illustrative but not limitative purpose), same invention is still to be considered susceptible of all those changes, additions, variants and the like which are in the reach of a mean technician and fall therefore in the scope and spirit of the following claims.

The invention claimed is:

1. System for extracting, dosing, dispensing with controllable, regular and continuous flows, liquids, creams, chocolates, jams, fruit, squashes and the like, from a container thereof, said system generally comprising an inner tube, a sac, a balloon, a bottle, and a valve, wherein said inner tube is a hollow rod (TU, TU') which extends from the top to the bottom of said container as an integral mono-body element comprising:

inlet-outlet holes (FO, OL) in the highest possible position on said inner tube for said liquid or cream to avoid the formation of air bubbles; and a bulkhead (BH) substantially beneath said inlet-outlet (FO, OL holes) defining within the hollow rod a major blind portion (BL) between said bulkhead (BH) and the a male top-shaped bottom terminal (TO);

said rod being provided with a thermoplastic liquids-containing sac (SAU) having a bottom female cavity (FC) to accommodate the male top-shaped bottom terminal (TO) of said rod, wherein said male top-shaped bottom terminal has a throat (GO) that couples with said female cavity.

2. System according to claim 1, characterized in that said rod is provided at its head with a collar having annular protrusions made of a thermoplastic material having a softening point lower than the melting point of the rod forming material.

3. System according to claim 1, characterized in that said bottom male top-shaped bottom terminal (TO) is shaped inversely to the female cavity in the bottle container.

4. System according to claim 1, characterized in that a small cylinder (CC) covered with rings (MR) made of high friction material is movably inserted in said blind portion (BL) of the rod, whereby few up-down strokes of said high friction rings on (CC) generate sufficient heat to enhance the floatability of the liquids or creams within the sac.

5. System according to claim 4, characterized in that said thermoplastic sac (SAU) is provided with an open mouth (B) to fit and seal on the low softening material of the collar protrusions (MR).

6. System according to claim 1, characterized in that the sac (SAU) has an umbrella like structure.

7. System according to claim 1, characterized in that said bottom female cavity (FC) is formed of an elastomeric balloon or vesica (PA).

8. Method for the embodiment of the system according to claim 1, comprising at least the following steps:

I) assembling the hollow rod with a tap and cap;

II) sealing a thermoplastic sac at the upper and lower ends of said rod;

III) fitting an elastomeric balloon or vesica (PA) well shod on the thermoplastic sac (SA);

IV) inserting in a bottle the assembly of the rod carrying tap and cap, of the thermoplastic sac and of the elastomeric balloon; and V) filling thee sac.

9. Method according to claim 8 comprising the steps of providing the hollow rod with:

(a) a male top-shaped terminal at the bottom thereof;

(b) a collar having ring protrusions made of a material with a low softening point at its upper portion;

(c) an upper bulk-head;

(d) a movable cylindrical body having high friction annular protrusions;

welding the mouth of an umbrella like sac to said low softening ring protrusions and welding or fitting said male terminal of the rod to a female cavity in the bottom of said umbrella sac;

inserting the so assembled rod-sac within an elastomeric balloon also provided with a bottom female cavity;

applying a tap and a cap on the rod head;

inserting the rod-sac-balloon-tap-cap assembly within a bottle or bag-box, and filling the sac with the liquids, creams, and the like, to be dispensed.

* * * * *